United States Patent [19]

Roston

[11] 4,383,713

[45] May 17, 1983

[54] ORTHOPEDIC SUPPORT APPARATUS FOR INFANTS

[76] Inventor: Stewart A. Roston, 681 River Ave., Lakewood, N.J. 08701

[21] Appl. No.: 223,345

[22] Filed: Jan. 8, 1981

[51] Int. Cl.[3] ..... A47C 27/00

[52] U.S. Cl. ..... 297/219; 5/431; 5/434; 297/DIG. 6; 297/397; 297/464

[58] Field of Search ..... 297/464, DIG. 4, DIG. 6, 297/391, 414, 397, 219; 5/431, 434, 436

[56] References Cited

U.S. PATENT DOCUMENTS

| | | | |
|---|---|---|---|
| 2,324,421 | 7/1943 | Ouellette | 297/310 |
| 2,404,505 | 7/1946 | Knecht | 297/467 |
| 2,652,183 | 9/1953 | Hlivka | 297/467 X |
| 2,908,766 | 10/1959 | Taylor | 297/219 X |
| 2,976,914 | 3/1961 | Miller | 297/DIG. 6 |
| 3,093,407 | 1/1963 | Wilson | 297/219 X |
| 3,220,767 | 11/1965 | Hendrickson | 297/DIG. 6 |
| 3,269,768 | 8/1966 | Kinney | 297/464 |
| 3,279,849 | 10/1966 | Radke et al. | 297/DIG. 6 |
| 3,296,635 | 1/1967 | O'Hanlan | 297/219 |
| 3,337,884 | 8/1967 | Meier | 297/219 |
| 3,542,421 | 11/1970 | Ambrose | 297/DIG. 6 |
| 3,649,075 | 3/1972 | Kalkowski | 297/219 |
| 3,792,897 | 2/1974 | Alson | 297/219 |
| 3,828,377 | 8/1974 | Fary, Sr. et al. | 297/392 |
| 3,992,657 | 11/1976 | Studebaker | 297/467 |
| 4,042,278 | 8/1977 | Jensen | 5/434 X |
| 4,047,757 | 9/1977 | Eames et al. | 297/219 X |
| 4,163,297 | 8/1979 | Neumark | 5/446 |
| 4,218,792 | 8/1980 | Kogan | 297/391 |
| 4,274,673 | 1/1981 | Kifferstein | 5/434 X |
| 4,275,472 | 6/1981 | Erck | 5/431 |

FOREIGN PATENT DOCUMENTS

| | | | |
|---|---|---|---|
| 4929 | of 1890 | United Kingdom | 297/219 |

*Primary Examiner*—James T. McCall

*Attorney, Agent, or Firm*—Arthur L. Plevy

[57] ABSTRACT

A support apparatus for infants is disclosed. The apparatus comprises a planar sheet fabricated from a relatively high pile material to which a Velcro fastener can be secured. Located on the planar sheet is a pillow member having a central aperture and a dependent outer flange which angularly slopes towards the central aperture. The bottom surface of the pillow has a central section for accommodating the neck of a child. The underside of the pillow has a Velcro fastener to enable positioning of the same on the surface of the planar member. Also included are left and right lateral support members which are emplaced at the sides of an infant when his head is emplaced within the pillow. The lateral support members also have Velcro backings to enable them to be selectively positioned on the planar sheet.

9 Claims, 6 Drawing Figures

ORTHOPEDIC SUPPORT APPARATUS FOR INFANTS

BACKGROUND OF THE INVENTION

This invention relates to orthopedic support apparatus for infants and more particularly to apparatus enabling an infant or young child to be properly supported while in a seated position.

Small children as infants from a few months to one year cannot support themselves conveniently in a seated position. The prior art has devised a number of various devices generally designated as baby holders, both for children's chairs, strollers and various other carriers of all sorts. Certain of these devices provide support means such as straps and harnesses which will enable the infant's mother or guardian to place the infant in the carrier and strap the infant in a comfortable position. In any event, certain of these devices suffer in that the infant is not properly supported and tends to assume uncomfortable and undesirable positions.

It is, of course, understood that it is desirable for the health and comfort of such infants as well as for the proper orthopedic development of such infants to maintain a relatively proper posture in order to keep the infant's head aligned with the spine. As one can readily ascertain, if the infant is allowed to assume a helpless prone posture, such a posture may result in various growth problems such as a tendency of the child to develop scoliosis, which is a lateral curvature of the spine.

It is thus extremely desirable to support a child in a relatively comfortable position when the child is emplaced in a baby carrier apparatus such as a stroller, car seat or various other devices. The prior art has been cognizant of the above problems and there are a great many patents which attempt to provide support for infants or young children in various manners.

For example, U.S. Pat. No. 2,324,421 entitled SUPPORTING STAND FOR INFANTS issued on July 13, 1943 to A. J. Ouellette describes a supporting stand for an infant which employs a harness and a crotch belt in combination with a supporting stand having protruding arms to allow the infant to lean from side to side. The apparatus does not provide good postural support.

U.S. Pat. No. 2,404,505 entitled BABY SUPPORTER issued on July 23, 1946 to M. P. Knecht shows a baby supporter which includes a belt that can be strapped around the baby and is attached or secured to a pad or cushion having a slight contour to accommodate the child's back.

Other patents as U.S. Pat No. 2,652,183 entitled BABY HOLDER FOR CHILDREN'S CHAIRS issued on Sept. 15, 1953 to B. Hlivka shows a holder for a child's chair, which holder is fabricated from a fabric and has a crotch or diaper section which is secured about the child to hold the child in place.

There are other patents such as U.S. Pat. No. 3,542,421 which show an adjustable back support for adults and which shows the use of adjustable Velcro pads. Other patents such as U.S. Pat. No. 3,992,057 and U.S. Pat. No. 4,186,961 depict adjustable chairs and automobile seats for accommodating a child.

Generally speaking, although the prior art is replete with a great number of patents relating to various support apparatus for infants, most of these devices suffer in that they do not properly support the child and cannot be easily adjustable to support infants of varying sizes. A further problem of many of the prior art devices is that they are not adapted to be used with alternate types of carriers such as strollers, car seats and so on. As one can ascertain from the prior art, many of these devices are permanently affixed to the baby carrier and therefore form an integral part therewith.

It is an object of the present invention to provide an improved support apparatus for an infant, which apparatus can accommodate infants of various sizes, while maintaining the infant in a proper postural position to thereby aid in the postural development of the child. The apparatus to be described is extremely simple to fabricate and relatively economical, while achieving an optimum support position for the child.

BRIEF DESCRIPTION OF THE PREFERRED EMBODIMENT

Orthopedic support apparatus for infants comprising a planar sheet member fabricated from a fabric like material having a top and bottom edge and two side edges, a pillow member removably positioned near the top edge of said planar sheet, said pillow member having a central depression with a relatively flat central portion at the bottom of said pillow directed towards said depression for accommodating the neck of said infant when the head of said infant is emplaced in said depression, first and second selectively positionable lateral support members positioned beneath said pillow for providing lateral support for the body sides of said infant when emplaced therein, whereby said infant can assume a desired postural position when accommodated by said apparatus.

DETAILED DESCRIPTION OF THE INVENTION

Figure 1:
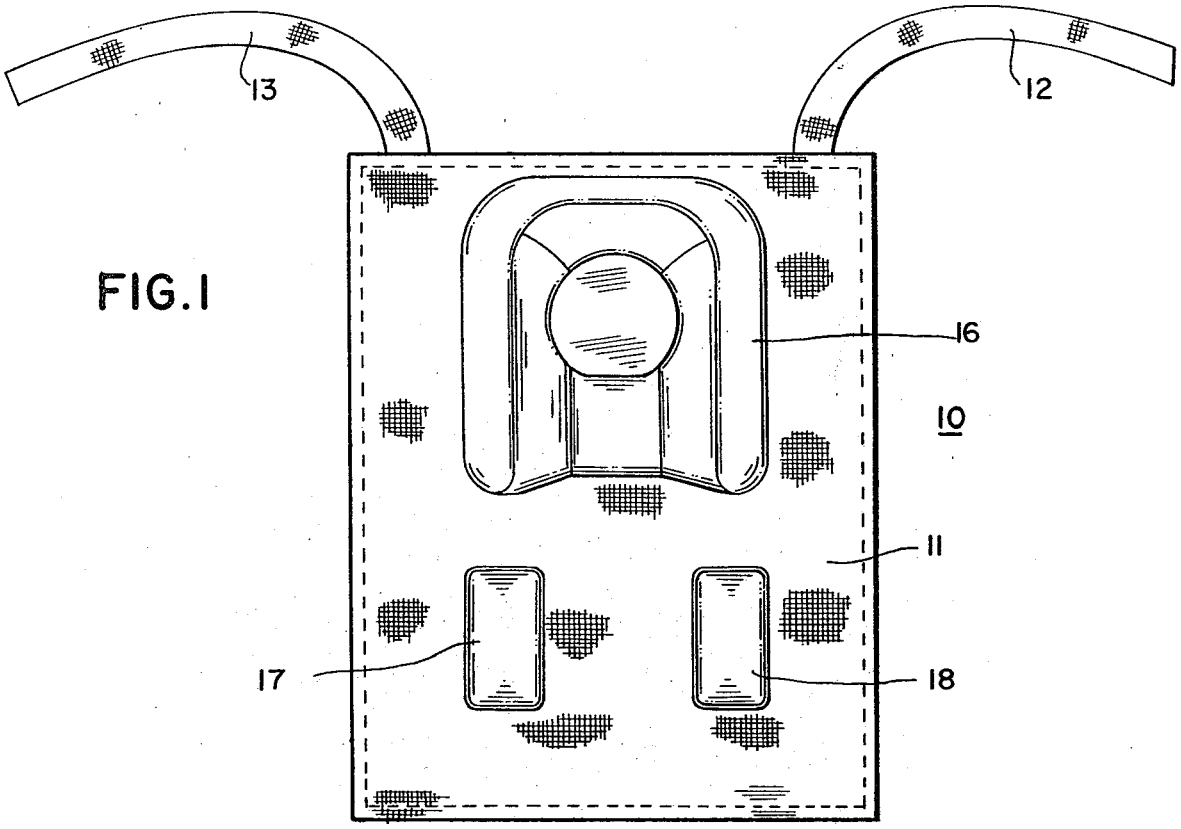
FIG. 1 is a front planar view of a support apparatus according to this invention.

Referring to FIG. 1, there is shown an orthopedic support apparatus 10 used to properly support an infant in a desired postural position. The support apparatus can be emplaced on the backs of various surfaces such as the back rest of a chair, stroller, or many devices which are presently employed to accommodate infants.

Essentially, the apparatus consists of a planar sheet of a fabric such as velour or velvet material which possesses a relatively high pile. The material may be folded and sewn to provide greater strength. The planar sheet has secured at the top side two strap members 12 and 13 to allow the unit to be draped or emplaced over the back rest of various devices and secured in position.

Located relatively central to the top is a pillow structure 16 into which the head of the child is positioned and maintained in position as will be described. Located beneath the pillow member 16 are lateral support members 17 and 18. The members 17 and 18 are generally rectangular in shape and have a bottom surface containing a layer of Velcro. In this manner, the members 17 and 18 can be adjustably positioned on the planar sheet 11 as the Velcro will firmly coact with the high pile material. The members 17 and 18 are positioned about the sides of the infant when the infant's head is emplaced within pillow 16. This will maintain the infant in a proper postural position.

As the infant grows, his head will continue to be accommodated by the pillow 16, while the lateral supports as 17 and 18 can be repositioned as desired.

Figure 2:
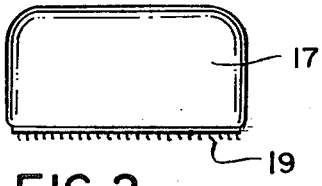
FIG. 2 is a side elevational view of a lateral support member.

FIG. 2 depicts a side view of the lateral support 17 showing the Velcro layer 19 secured thereto. It is, of course, understood that while members 17 and 18 are shown to be generally rectangular in configuration, any alternate configuration can be employed to enable the lateral support of the child.

Figure 3:
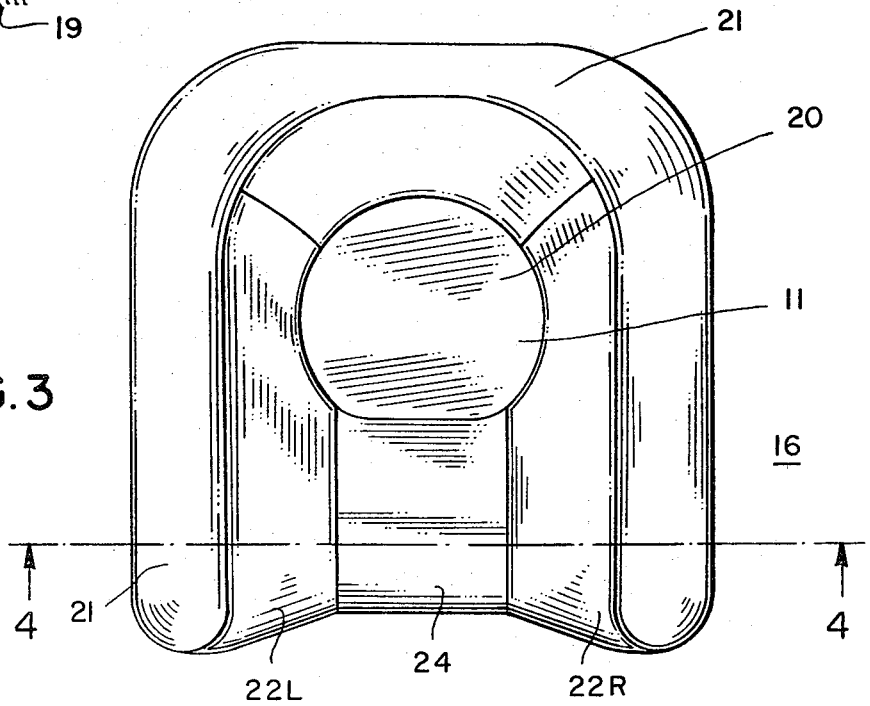
FIG. 3 is a front plan view of a pillow member according to this invention.

Referring to FIG. 3, there is shown a more detailed view of the pillow 16. Essentially, the pillow 16 has a central aperture or depression 20 underlying the planar sheet 11. The pillow, as shown, has an outer peripheral flange 21 and the angular right and left portions 22R and 22L which taper towards the aperture or central depression 20. The bottom edge of the pillow has a relatively flat central section 24 which accommodates the neck of the child.

Figure 4:
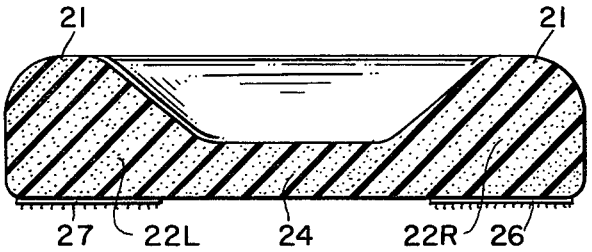
FIG. 4 is a sectional view taken through line 4—4 of FIG. 3.

Referring to FIG. 4, there is shown a cross section of the pillow taken through lines 4—4 of FIG. 3 to show the contour of the pillow.

Figure 5:
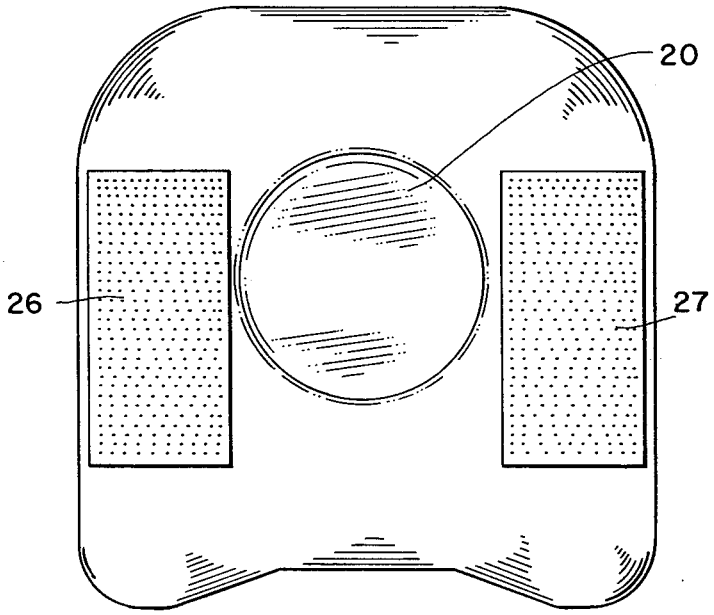
FIG. 5 is a rear view of the pillow.

The back side of the pillow is shown in FIG. 5 and has two Velcro pads 26 and 27 secured thereto to thereby enable the user to position the pillow section on the planar sheet in order to properly accommodate the infant.

Figure 6:
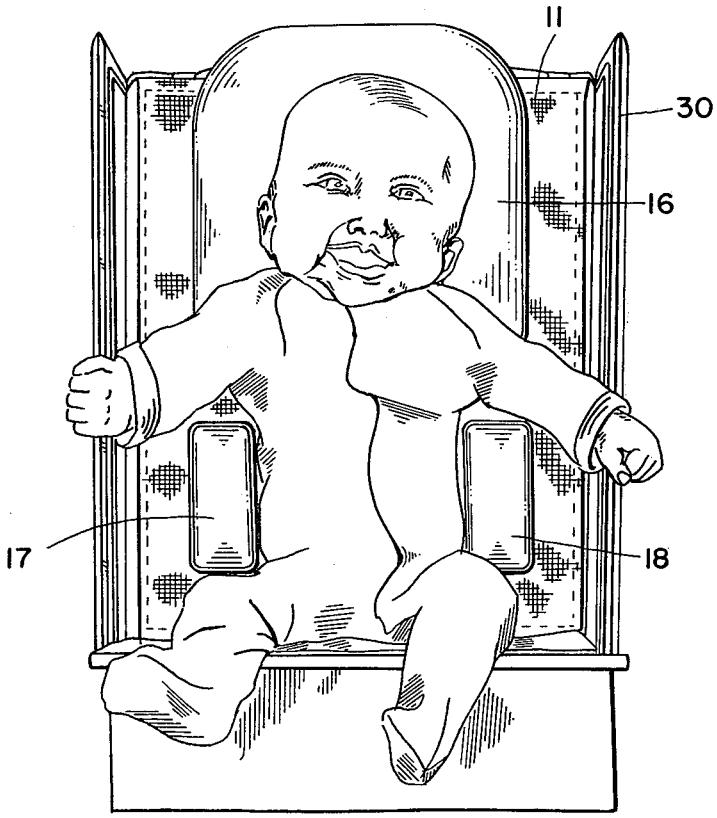
FIG. 6 is a front perspective view depicting a child being accommodated by the apparatus.

FIG. 6 depicts a view of a child in a seated position employing the apparatus depicted above. The numeral 30 refers to a back rest which may be associated with a typical stroller, infant chair or other device. The planar sheet 11 is emplaced over the back rest and secured in place by means of the straps 12 and 13 or any other suitable means. The head of the child is emplaced within aperture 20 with the flange 22 comfortably encircling the same. The pillow is emplaced so that the bottom contour coacts with the shoulders of the child. The neck portion of the child is mainly contained within the central region 24 and is further supported by the sloping sidewalls 22L and 22R of the pillow member 16.

As indicated, the position of the pillow with respect to the planar member 11 is completely adjustable by means of the Velcro fasteners 26 and 27 which firmly adhere to the relatively high pile material. The lateral side supports 17 and 18 are positioned at the sides of the child as shown in the figure to thereby maintain the child in the position shown in FIG. 6, which position is a proper and desirable seating position serving to fully support the head and spine of the child.

Due to the shape of the pillow 16, the child can move its head within the central confines of the pillow in a predetermined amount. The position of members 17 and 18 as well as the pillow member 16 can, of course, be adjusted as the child grows or for various other purposes.

It is, of course, understood that the pillow 16 as well as the side supports 17 and 18 are all fabricated from conventional materials and may be fabricated from a foam rubber coated with a soft plastic or be fabricated as normal pillow structures having an outer cloth covering and stuffed with a suitable soft material, such as a down or a plush filler.

The infant may be further secured in position by means of a strap or belt which can be employed to encircle the waist of the infant, if desired. In any event, for infants who are relatively young, it has been found that placing the child's head in the pillow 16 and by the proper positioning of the lateral supports 17 and 18, additional strapping means are not normally required.

The above apparatus has been proven to be quite successful in maintaining a child in the proper postural position as well as the further fact that the child is completely content and comfortable when emplaced in the apparatus.

The major aspect of the present invention, of course, resides in the fact that the pillow and the lateral supports are completely adjustable and can be positioned based on the posture of the child or based on the size of the child as the child grows and develops. The pillow is significant because of the importance of the proper formation of both the cervical curvature and the contour shaping of the child's skull. The tapering in shape of the central neck support area 24 of the pillow gradually increases in height the further from the center and hence, contacts the neck more firmly for proper support. This allows for the rapid growth which takes place in an infant. The aperture 20 in the center of the pillow helps form the back of the infant's skull by placing the skull into the depression 20 which contacts the skull from all sides. Accordingly, the significance of the pillow is to allow rotational and flexion of the skull, but not to allow lateral flexion in the infant. The manner in which the pillow contacts the shoulders supports the neck, helps in the formation of the skull and will aid in reducing spinal curvature of an infant as he grows and hence, to circumvent many problems which will result from a substantial curvature.

While there has been described a preferred embodiment of apparatus, it is, of course, understood that many alternate embodiments can be employed without departing from the spirit and scope of this invention. Hence, it is understood that alternate means for securing the device to the back rest of a carrier can be employed in lieu of straps 12 and 13. The pillow configuration is extremely important in maintaining the child in the proper position, while the adjustability afforded by the Velcro layers enable one to selectively position the pillow and the lateral supports as desired. These and other features are deemed to be within the scope and breadth of this invention as encompassed by the following claims appended hereto.

I claim:

1. Orthopedic support apparatus for infants, comprising:

(a) a planar sheet member fabricated from a fabric like material having a top and bottom edge and two side edges;

(b) a pillow member removably positioned near the top edge of said planar sheet, said pillow member having a curved top edge contiguous with relatively parallel right and left sides and a relatively flat bottom edge, with a peripheral upwardly extending flange directed from said side surfaces and about said top surface with said flange having sloping sidewalls directed from said side surfaces and said top edge towards a central depression with said central depression having a flat central portion extending from the bottom of said pillow to said central depresion for accommodating the neck of said infant when the head of said infant is emplaced in said depression with the bottom edges between said flat central portion and said right and left sides forming a shoulder support for said infant, and (c) first and second selectively postionable lateral support members positioned beneath said pillow for providing lateral support for the body sides of said infant when emplaced therein, whereby said infant can assume a desired postural position when accommodated by said apparatus.

2. The support apparatus according to claim 1 wherein said planar sheet member is fabricated from a fabric having a relatively high pile.

3. The support apparatus according to claim 2 wherein the rear surface of said pillow as positioned on said sheet includes at least one Velcro layer for selectively securing said pillow to said sheet.

4. The support apparatus according to claim 3 wherein said first and second lateral support members are generally rectangular in configuration each having a bottom surface containing a Velcro fastener for selectively securing the same to said sheet at a desired position.

5. The support apparatus according to claim 1 further including fastening means coupled to said sheet near said top edge to enable said sheet to be secured to the back rest of an infant carrier device.

6. The support apparatus according to claim 2 wherein said fabric is velour.

7. The support apparatus according to claim 1 wherein said central depression is relatively circular in configuration.

8. The support apparatus according to claim 1 wherein said pillow member and said lateral support members are fabricated from a soft elastomeric material.

9. The support apparatus according to claim 5 wherein said fastening means comprises a right and left strap secured to said planar sheet at said top edge with said right strap positioned nearest said right side edge and said left strap positioned near said left side edge.

* * * * *